US008813793B2

(12) United States Patent
Boboltz

(10) Patent No.: US 8,813,793 B2
(45) Date of Patent: Aug. 26, 2014

(54) PAINT FORMULATION AND DISPENSING APPARATUS

(75) Inventor: Scott Boboltz, Okemos, MI (US)

(73) Assignee: Dedoes Industries, Inc., Walled Lake, MI (US)

( * ) Notice: Subject to any disclaimer, the term of this patent is extended or adjusted under 35 U.S.C. 154(b) by 654 days.

(21) Appl. No.: 13/196,310

(22) Filed: Aug. 2, 2011

(65) Prior Publication Data

US 2013/0032244 A1 Feb. 7, 2013

(51) Int. Cl.
*B01F 13/10* (2006.01)
*B01F 15/02* (2006.01)
*B01F 15/04* (2006.01)

(52) U.S. Cl.
CPC ..... *B01F 13/1066* (2013.01); *B01F 13/1063* (2013.01); *B01F 15/0237* (2013.01); *B01F 15/0445* (2013.01)
USPC ..... 141/83; 141/104; 141/320

(58) Field of Classification Search
CPC .. B01F 13/10; B01F 13/1055; B01F 13/1061; B01F 13/1063; B01F 13/1066; B01F 15/0237; B01F 15/0441; B01F 15/0445
USPC ..... 141/83, 104–106, 319–320
See application file for complete search history.

(56) References Cited

U.S. PATENT DOCUMENTS 2,985,339 A * 5/1961 Fischer et al. ..... 222/44
3,006,505 A * 10/1961 Isador ..... 222/26
3,122,272 A * 2/1964 Lyle ..... 222/26
3,178,058 A * 4/1965 Ogren ..... 222/41
4,637,527 A * 1/1987 Arrigoni ..... 222/144
4,967,938 A * 11/1990 Hellenberg ..... 222/144
5,445,195 A * 8/1995 Kim ..... 141/104
5,493,840 A * 2/1996 Cane ..... 53/50
5,718,268 A 2/1998 Muscara
5,938,080 A * 8/1999 Haaser et al. ..... 222/144
6,053,218 A * 4/2000 Boers ..... 141/83
6,234,218 B1 5/2001 Boers
6,701,977 B2 * 3/2004 Taylor et al. ..... 141/83
6,926,171 B2 * 8/2005 Reedy et al. ..... 222/108
6,957,672 B2 * 10/2005 Taylor et al. ..... 141/83
6,991,004 B2 * 1/2006 Kaufhold et al. ..... 141/83
7,147,012 B2 * 12/2006 Kaufhold et al. ..... 141/11
7,540,652 B2 * 6/2009 Krzywdziak et al. ..... 366/247
8,528,605 B2 * 9/2013 Smith ..... 141/9
8,746,291 B2 * 6/2014 Hertz et al. ..... 141/11
2003/0019537 A1 * 1/2003 Taylor et al. ..... 141/83
2004/0250873 A1 * 12/2004 Taylor et al. ..... 141/83
2005/0092386 A1 * 5/2005 Kaufhold et al. ..... 141/9

(Continued)

*Primary Examiner* — Nicolas A Arnett
(74) *Attorney, Agent, or Firm* — Gifford, Krass, Sprinkle, Anderson & Citkowski, P.C.

(57) ABSTRACT

A paint formulation and dispensing apparatus for mixing paint from a can having an open top and to a receiving can. The apparatus includes a dispensing lid attached to the paint can so that the lid overlies the open top of the paint can. The lid includes a spout and a reservoir having a plunger slidably disposed in it such that the position of the plunger determines the volume of the reservoir. A valve is disposed in a passageway in the lid and is movable between a first position in which the valve fluidly connects the passageway to the reservoir, and a second position in which the valve fluidly connects the reservoir to the spout. A weight scale is positioned below the spout and the receiving can is positioned on the weight scale. The weight scale generates an electronic signal to a programmed processor which generates output signals to control both the position of the valve as well as the position of an actuator which engages the plunger.

17 Claims, 13 Drawing Sheets

(56) References Cited

U.S. PATENT DOCUMENTS

2005/0278066 A1 12/2005 Graves et al.
2006/0076080 A1* 4/2006 Salas ..... 141/104
2006/0086405 A1* 4/2006 Kaufhold et al. ..... 141/83
2007/0095421 A1* 5/2007 Page ..... 141/83
2008/0257446 A1* 10/2008 Oakes ..... 141/1
2009/0166383 A1 7/2009 Canfield
2009/0248199 A1* 10/2009 Milhorn ..... 700/239
2010/0300181 A1* 12/2010 Zech et al. ..... 73/54.01

* cited by examiner

PAINT FORMULATION AND DISPENSING APPARATUS

BACKGROUND OF THE INVENTION

I. Field of the Invention

The invention relates generally to paint formulation and dispensing apparatuses.

II. Description of Related Art

There are many situations where it is necessary to add relatively small amounts of pigmented paint to a base color in order to achieve the desired end color for the paint. Such paint mixing allows a wide variety of colors to be mixed as well as matched without the necessity of actually maintaining an inventory of each of the separate end colors.

In one application, paint mixers are utilized in automotive paint shops for mixing the precise color necessary to paint an automotive vehicle. In one such type of paint mixing system, a receiving can for receiving the paint is placed on an electronic scale which generates an electronic output signal representative of the weight within the receiving can. The electronic scale is electrically connected to a processor which, in turn, has access to a database of different paint colors. Consequently, after the operator inputs the desired color, the processor is able to access the database to determine both the color and weight of additional pigmented paint necessary to be added to the receiving can to achieve the desired end color.

After the type and amount of pigmented paint is determined, the processor activates a mechanism which engages and then tilts an open paint can of the pigmented paint thus pouring paint into the receiving can. When enough paint has been poured into the receiving can, the mechanism tilts the paint can to stop the paint pouring process.

A primary disadvantage of these previously known painting systems is that the overall paint mixing system is expensive to obtain and maintain. Furthermore, these previously known paint mixing systems are prone to inaccuracies and are fairly slow in operation since the amount of pigmented paint, and thus the amount of tilting of the paint can necessary to dispense the paint, varies from one pigmented color and to another. Another disadvantage is that these systems require periodic software upgrades, as they do not utilize the original formulation software provided by the paint manufacturer.

SUMMARY OF THE PRESENT INVENTION

The present invention provides a paint formulation and dispensing apparatus for mixing paints from a paint can and to a receiving can which overcomes the above-mentioned disadvantages of the previously known devices.

In brief, the present invention includes a dispensing lid which is attached to the can of pigmented paint so that the lid overlies an open top of the paint can. In practice, each lid will be associated with a single can of pigmented paint until all of the paint from that can is dispensed.

The lid includes a dispensing spout, a paint reservoir, and a fluid passageway which is connected at one end to the open top of the paint can. A valve is disposed in the passageway and is movable between a first position and a second position. In its first position, the valve fluidly connects the passageway to the reservoir while in its second position, the valve fluidly connects the reservoir with the spout and disconnects the reservoir from the paint can.

A plunger is slidably disposed in and sealed to the reservoir. Consequently, the position of the plunger in the reservoir determines the volume of paint within the reservoir.

The mixing apparatus further includes a housing having an electronic weight scale which generates an output signal representative of the weight on the scale. The output from the scale is received by a programmed processor which also has access to a database containing paint mixing data for achieving different paint colors.

The housing also includes a lid support which supports the dispensing lid in an inverted position, i.e. with the paint can extending upwardly from the lid. Once the dispensing lid is positioned on the lid support, the lid spout is positioned in alignment and above a receiving can positioned on the weight scale. In addition, with the lid positioned on the lid support, an actuator engages the reservoir plunger such that the actuator controls the position of the plunger within the reservoir.

In operation, the lid is first positioned on the lid support and so that the actuator engages the plunger. The processor, after receiving the desired paint color as an input from the user, activates a control rod to move the valve to its first position so that the reservoir is fluidly connected to the open top of the paint can. The actuator then moves the piston upwardly which inducts paint from the paint can into the reservoir.

After the reservoir has been at least partially filled, the processor actuates the valve to its second position so that the reservoir is fluidly connected to the spout positioned above the receiving can on the weight scale. The processor then moves the actuator downwardly thus ejecting the paint from the reservoir, out through the spout and into the receiving can. As the paint is added to the receiving can, the scale generates an output signal representative of the increasing weight of the can.

When the desired amount of paint from the paint can in the dispensing lid has been dispensed into the receiving can, the processor generates an output signal to the actuator to not only stop the downward movement of the plunger, but also to elevate the plunger slightly which both accurately and abruptly stops the flow from the reservoir and into the receiving can. The processor then actuates the valve actuator to move the valve back to its first position thus fluidly connecting the reservoir to the open top of the paint can. Downward movement of the plunger by the actuator then pumps the paint from the reservoir back into the can.

The above process is repeated for each different paint color necessary to achieve the desired end color.

In the preferred embodiment of the invention, the housing includes two paint can receiving stations for alternatively loading, mixing, and unloading paint. The use of two receiving stations facilitates rapid paint mixing.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 5:
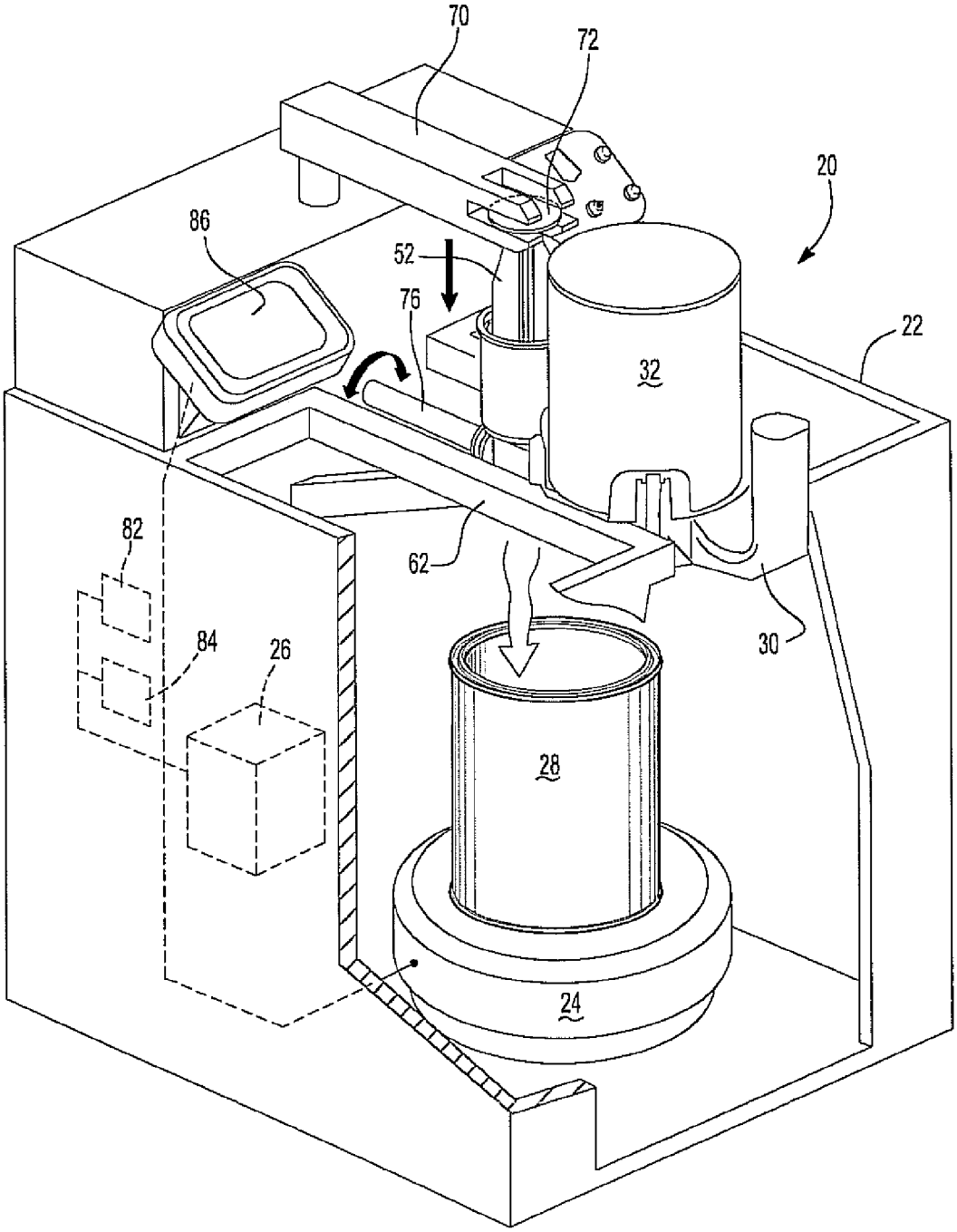
FIG. 5 is an elevational view illustrating the overall paint formulation and dispensing apparatus.

With reference first to FIG. 5, a preferred embodiment of a paint formulation and dispensing apparatus 20 according to the present invention is shown. The paint formulation and dispensing apparatus includes a housing 22 which supports an electronic scale 24. The electronic scale 24 provides an electrical output signal to a processor 26 representative of the weight on the scale 24.

A receiving can 28 is positioned on the weight scale 24. The receiving can 28 typically will be either empty or contain a first color. As such, pigmented paint or other colors must be added to the receiving can 28 in order to achieve the desired end color. Furthermore, as each pigmented color is added to the receiving can 28, the weight scale 24 changes the output signal to the processor 26 to reflect the increased weight in the receiving can 28.

In a fashion that will be subsequently described in greater detail, a dispensing lid 30 is attached to a dispensing can 32 containing the desired pigment, or at least one of the desired pigments, necessary to be added to the receiving can 28 in order to achieve the end color. The construction and operation of the dispensing lid 30, furthermore, may be more clearly understood by reference to FIGS. 1-3.

Figure 1:
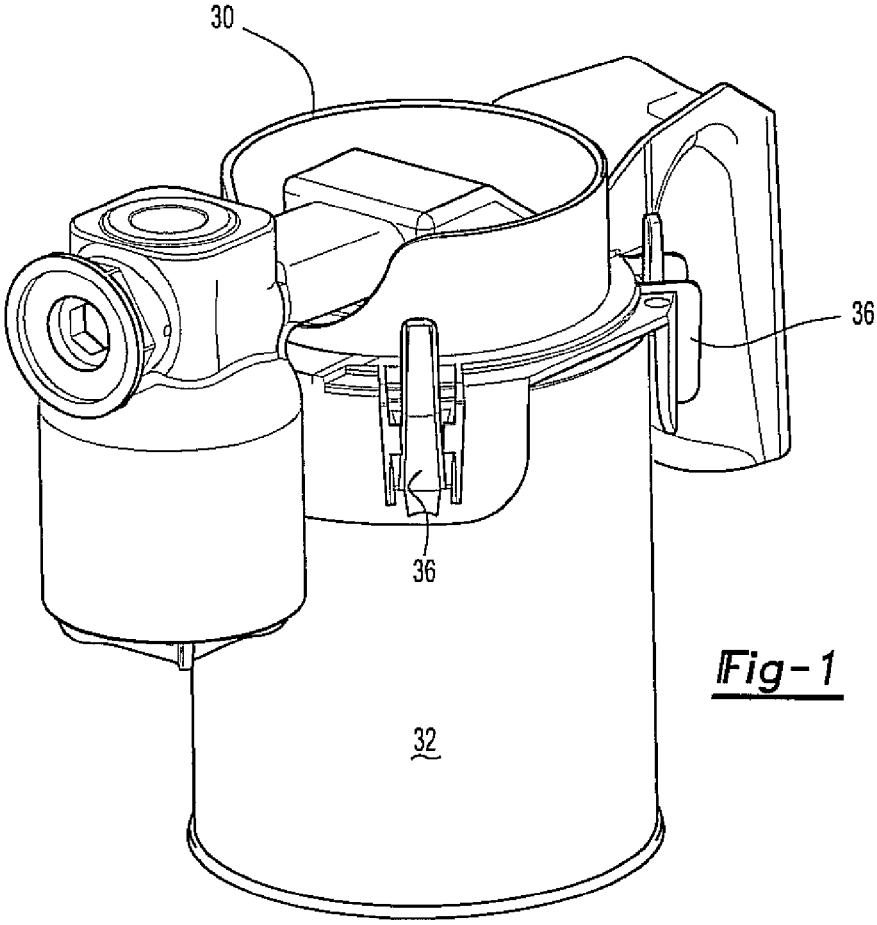
FIG. 1 is an elevational view illustrating a preferred embodiment of a dispensing lid mounted on a paint can.
Figure 2:
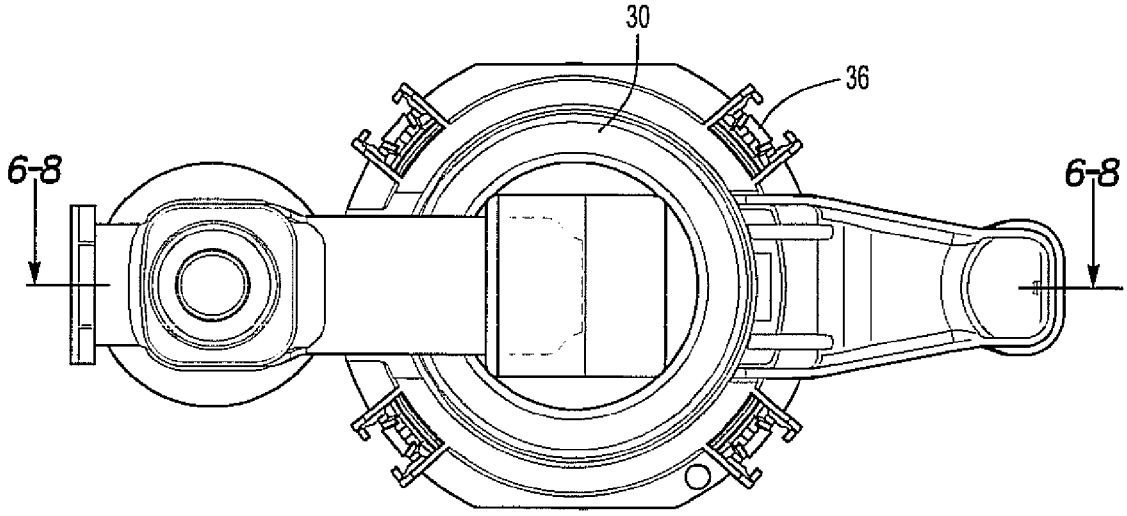
FIG. 2 is a top view of the dispensing lid mounted on the paint can.
Figure 3:
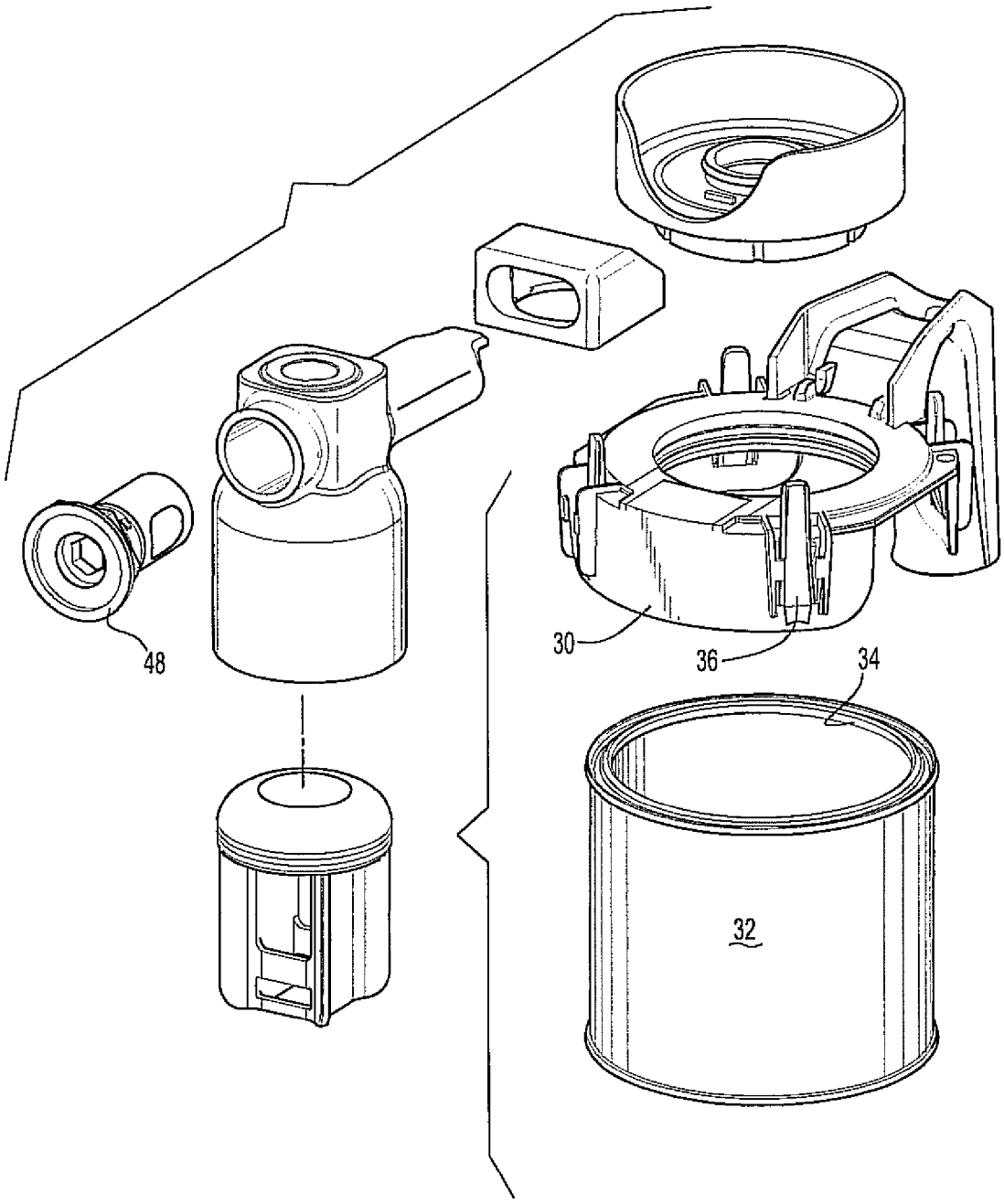
FIG. 3 is an exploded view of the dispensing lid.

With reference then to FIGS. 1-3, the dispensing lid 30 is shown in greater detail in which the dispensing can 32 includes an open top 34. The dispensing lid 30 is removably positioned across the open top 34 of the dispensing can 32 so that the dispensing lid 30 overlies and covers the open top 34 of the dispensing can 32.

Any conventional means may be used to removably attach the dispensing lid 30 to the can 32 so that the dispensing lid overlies the open top of the dispensing can 32. However, as shown, the dispensing lid 30 includes snap locks 36 which are described in greater detail in U.S. Pat. No. 7,540,652, which is incorporated herein by reference. Other mechanisms for attaching the lid 30 to the can 32, however, may be utilized without deviation from the spirit or scope of the invention.

Figure 6:
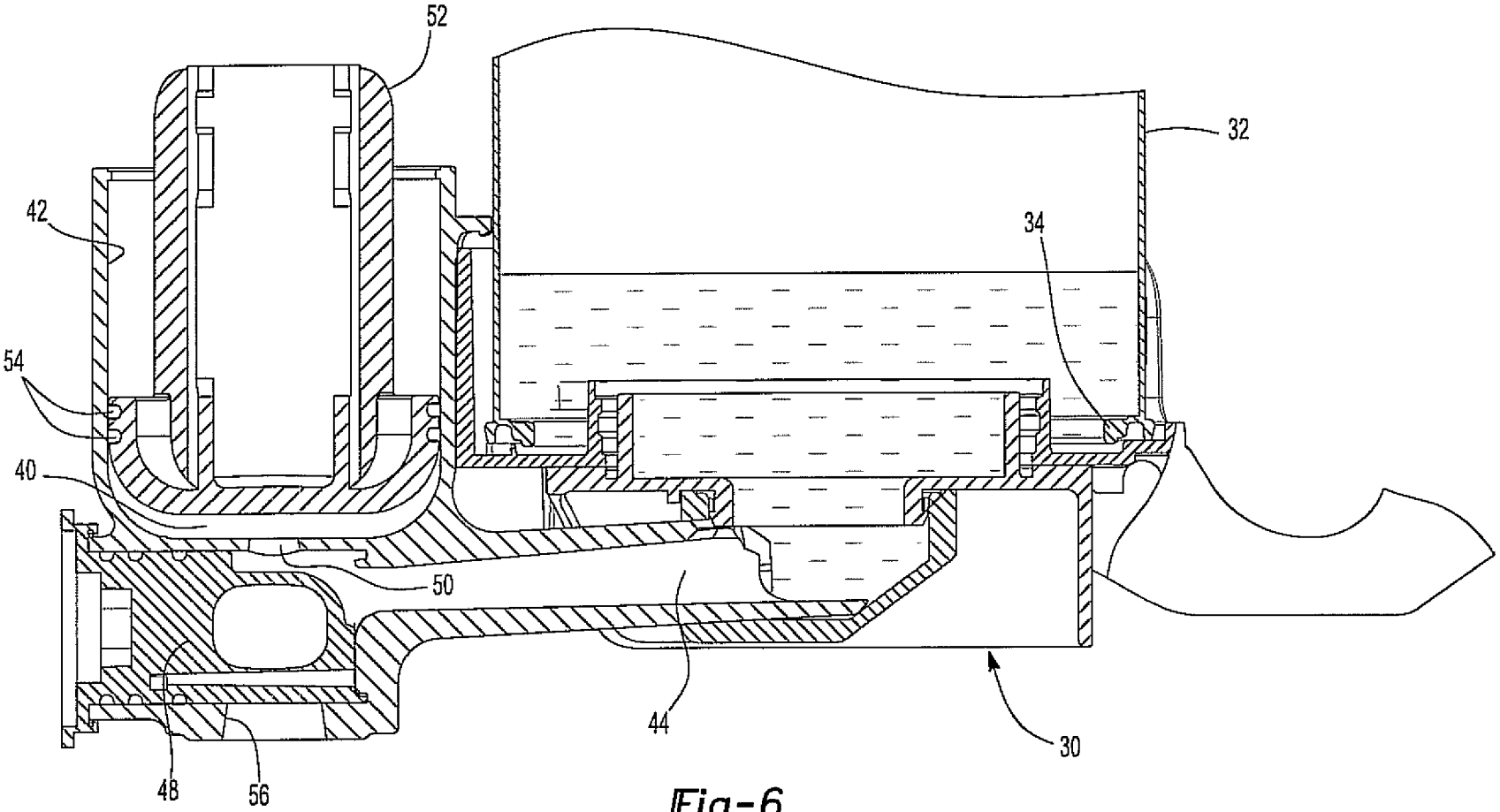
FIG. 6 is a fragmentary sectional view illustrating the dispensing lid.

With reference now to FIGS. 3 and 6, the dispensing lid 30 includes a reservoir 40 having side walls 42 which define the shape and size of the reservoir 40. This reservoir 40, furthermore, is shown in FIG. 6 in the inverted position, i.e. the position when the paint can 32 is positioned in the housing 22 as shown in FIG. 5, as contrasted to the storage position illustrated in FIG. 3.

A passageway 44 is formed in the dispensing lid 30 which is open at one end to the open top of the dispensing lid 30 and thus to the pigmented paint contained in the paint can 32. As shown in FIG. 6, this passageway extends outwardly from the paint can 32 toward the reservoir 40.

Figure 7:
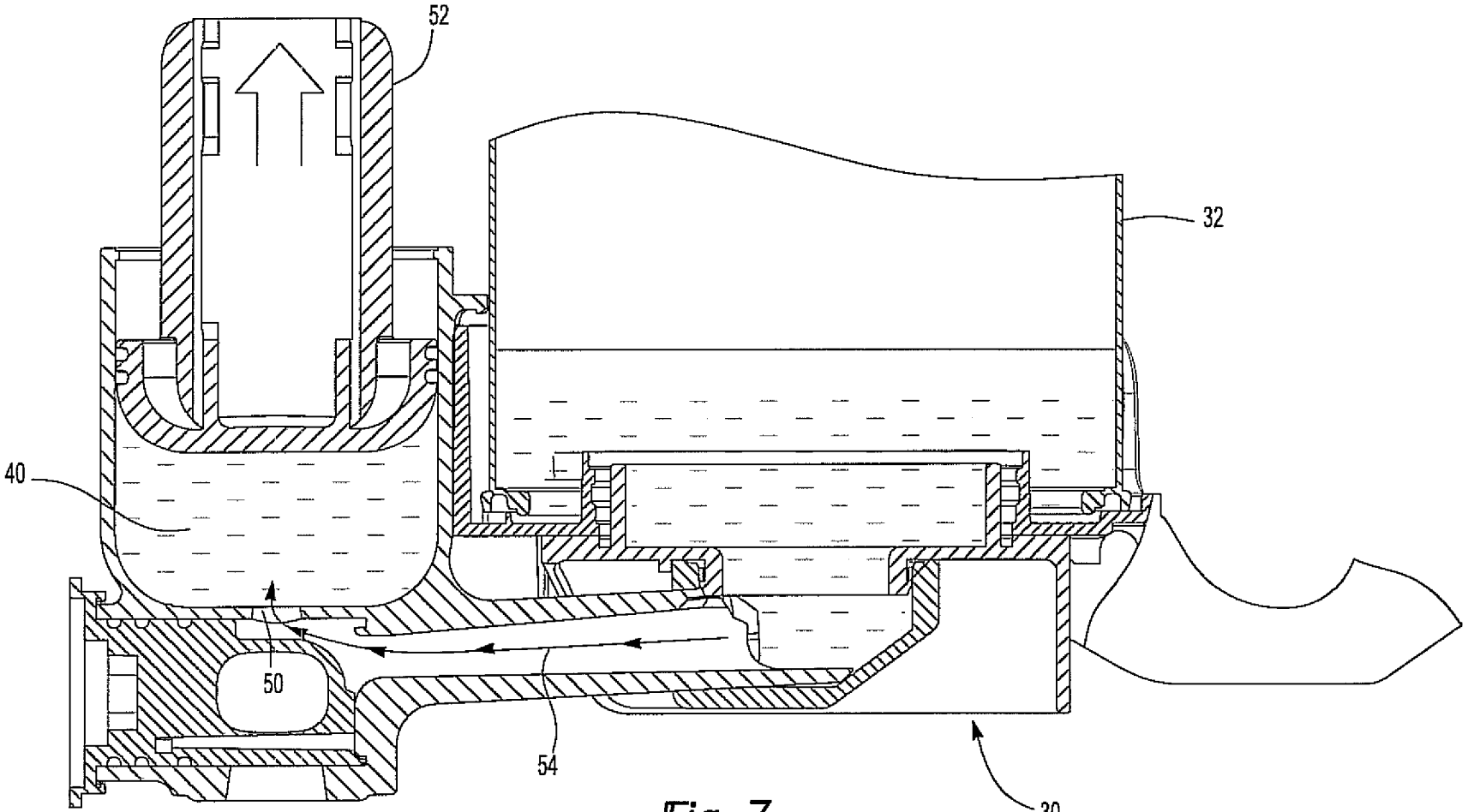
FIG. 7 is a view similar to FIG. 6 but illustrating the filling of the paint reservoir in the dispensing lid.
Figure 8:
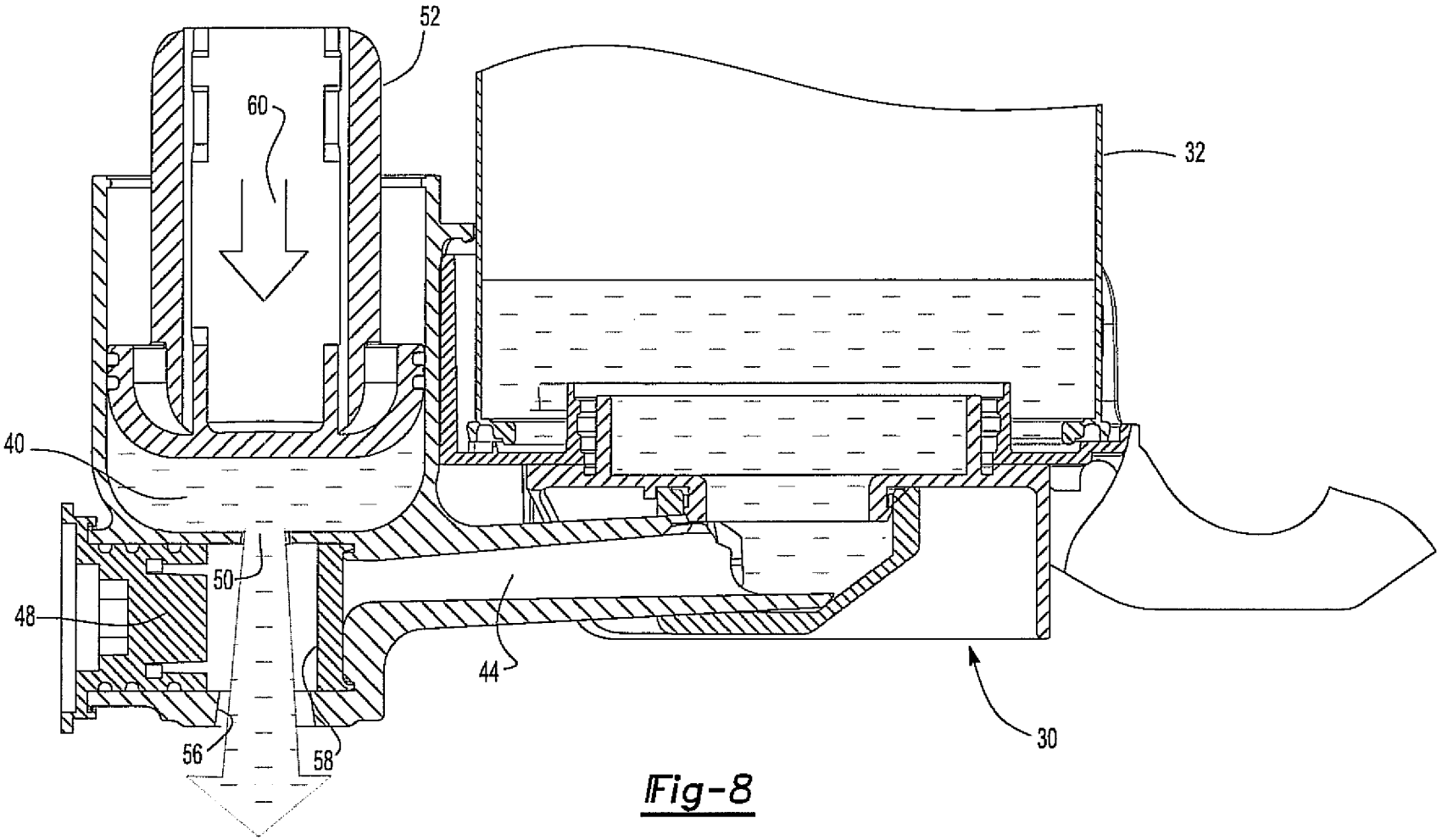
FIG. 8 is a view similar to FIGS. 6 and 7, but illustrating the valve in its second position for dispensing paint to the receiving can.

Referring now to FIGS. 3, 6 and 7, a valve 48 is rotatably mounted to the dispensing lid 30 and rotatable between a first position, illustrated in FIG. 6, and a second position, illustrated in FIG. 8. In its first position, the valve 48 is fluidly open to one end of the passageway 44 such that the valve 48 establishes fluid communication from the paint can 32, through the passageway 44 and a port 50 to the reservoir 40.

A plunger 52 is slidably mounted within the reservoir 40 so that the plunger sealingly engages the reservoir walls 42. Preferably, the plunger 52 includes fluid seals 54 to enhance a fluid-tight seal between the plunger 52 and the reservoir walls 42.

The plunger is movable within the reservoir 40 between the position shown in FIG. 6 in which the plunger 52 is positioned closely adjacent the port 50, and the position shown in FIG. 7 in which the plunger 52 is spaced from the port 50. Consequently, with the valve 48 in its first position, as the plunger 52 moves from the position shown in FIG. 6 and to the position shown in FIG. 7, the plunger 52 inducts paint from the paint can 32 and into the reservoir 40 as shown by arrow 54 in FIG. 7.

With reference now to FIGS. 3 and 8, the dispensing lid 30 further includes a dispensing spout 56 preferably positioned beneath the reservoir 40 when the reservoir is in its inverted position as shown in FIG. 8. When it is desired to dispense paint from the reservoir 40, through the spout and into the receiving can 28 (FIG. 5), the valve 48 is rotated to its second position illustrated in FIG. 8. In its second position, the valve 48 terminates the fluid connection between the passageway 44 and the reservoir 40. However, with the valve 48 in its second position, a through bore 58 fluidly connects the spout to the port 50 and thus to the reservoir 40. Consequently, upon downward movement of the plunger 52 when the dispensing lid 30 is in its inverted position and as shown by arrow 60, the plunger 52 pumps paint out of the reservoir 40, through the through bore 58, out through the spout 56 and into the receiving can 28 (FIG. 5).

Figure 4:
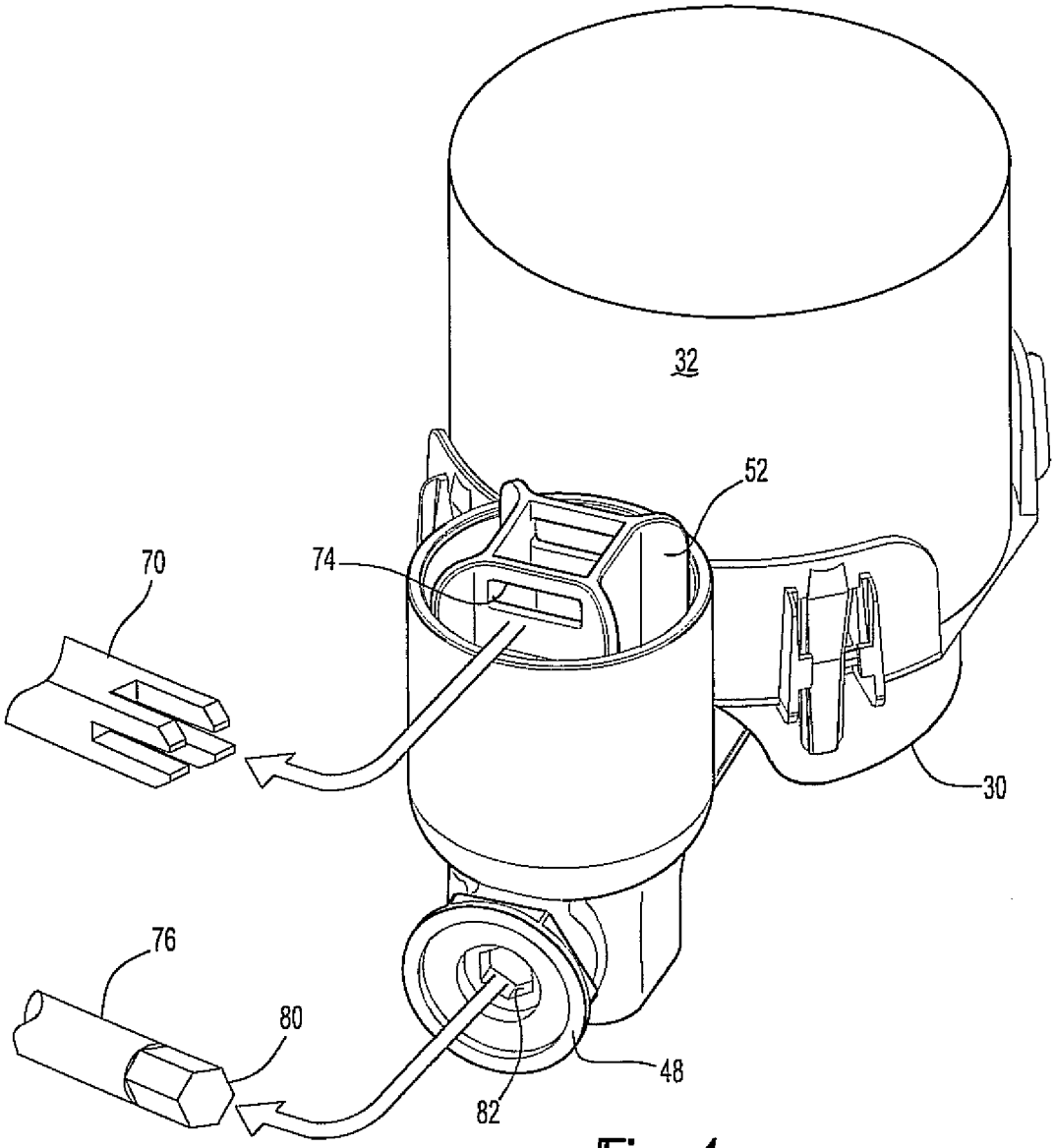
FIG. 4 is a diagrammatic view illustrating the attachment of both the plunger actuator and valve actuator.

With reference now to FIGS. 4 and 5, the apparatus housing 22 includes one or more lid supports 62 which support the dispensing lid 30, as well as its attached can 32, on the housing 22 so that the can 32 is in an inverted position, i.e. extending upwardly from the dispensing lid 30. With the dispensing lid 30 positioned onto the lid supports 32 as shown in FIG. 5, a vertically movable actuator 70 engages a handle 72 on the plunger 52 such that the actuator 70 and plunger 52 vertically move in unison with each other.

The actual configuration of the plunger handle 72 is unimportant. For example, as shown in FIG. 5, the plunger handle is illustrated as a round knob which is engaged by forks on the end of the plunger actuator 70 so that the plunger actuator 70 and plunger 52 move in unison with each other. Alternatively, the handle may simply be an opening 74 as shown in FIG. 4 which is engaged by the forks at the end of the actuator 70 to lock the plunger 52 and actuator 70 together. The only important design feature is that the actuator 70 and plunger 52 move in unison with each other.

Still referring to FIGS. 2 and 5, as the dispensing lid 30 is positioned on the lid support 62, a valve actuator 76 also engages the valve 48 so that the valve actuator 76 and valve 48 rotate in unison with each other. Although any mechanism may be used to lock the valve actuator 70 and valve 48 together for simultaneous rotation with each other, as shown in FIG. 4, the valve actuator 76 includes a hex end 80 which engages a hex recess 82 in the valve 48.

As shown in FIG. 5, the processor 26 controls the vertical position of the first actuator 70 by a first actuator controller 82. Similarly, the processor 26 controls the rotational position of the valve actuator 76 by a valve actuator controller 84. Furthermore, the construction and operation of both actuators 70 and 76, as well as their controllers 82 and 84, is conventional in construction and well known to those skilled in the art.

With reference now to FIG. 5, in operation the dispensing lid is positioned on the lid support 62 so that the valve actuator 76 engages the valve 48 and, simultaneously, the plunger actuator 70 engages the plunger 52. At this time, the spout 56 in the dispensing lid is positioned above the receiving can 28 so that any paint dispensed from the reservoir and out through the dispensing spout 56 enters into the receiving can 28.

The machine operator inputs the desired end color to the processor 26. Any conventional means, such as a touch pad 86, may be used to input this information to the processor 26. Once inputted, the processor 26 accesses the database containing paint color information and the amount or weight of each different paint pigment required to achieve the desired end color.

The processor 26 then actuates both the valve actuator 76 to move the valve to its first position (FIG. 6) and also moves the piston actuator 70 upwardly to the position shown in FIG. 7 thus inducting paint into the reservoir 40. Once the reservoir 40 has been filled with a sufficient amount of paint, the processor 26 stops the upward movement of the piston actuator 70. The processor 26 then rotates the valve 48 to its second position (FIG. 8) through the valve actuator 76. The processor 26 then moves the piston actuator 7 downwardly thus dispensing paint from the reservoir 40 and into the receiving can 28.

When a sufficient amount of paint has been dispensed into the receiving can 28 as the processor determines from the output signal from the scale 24, the processor 26 terminates the downward movement of the piston actuator 70.

The processor 26 then rotates the valve 48 to its first position (FIG. 6) thus again connecting the reservoir 40 to the paint can 32. The processor 26 then actuates the piston actuator 70 to move the piston actuator 70 downwardly thus returning the paint from the reservoir 40 back to the can 32. Then the paint can 32 with its attached lid 30 is removed from the lid support 62 and the above process repeated for any other paint colors or pigments required.

Figure 9:
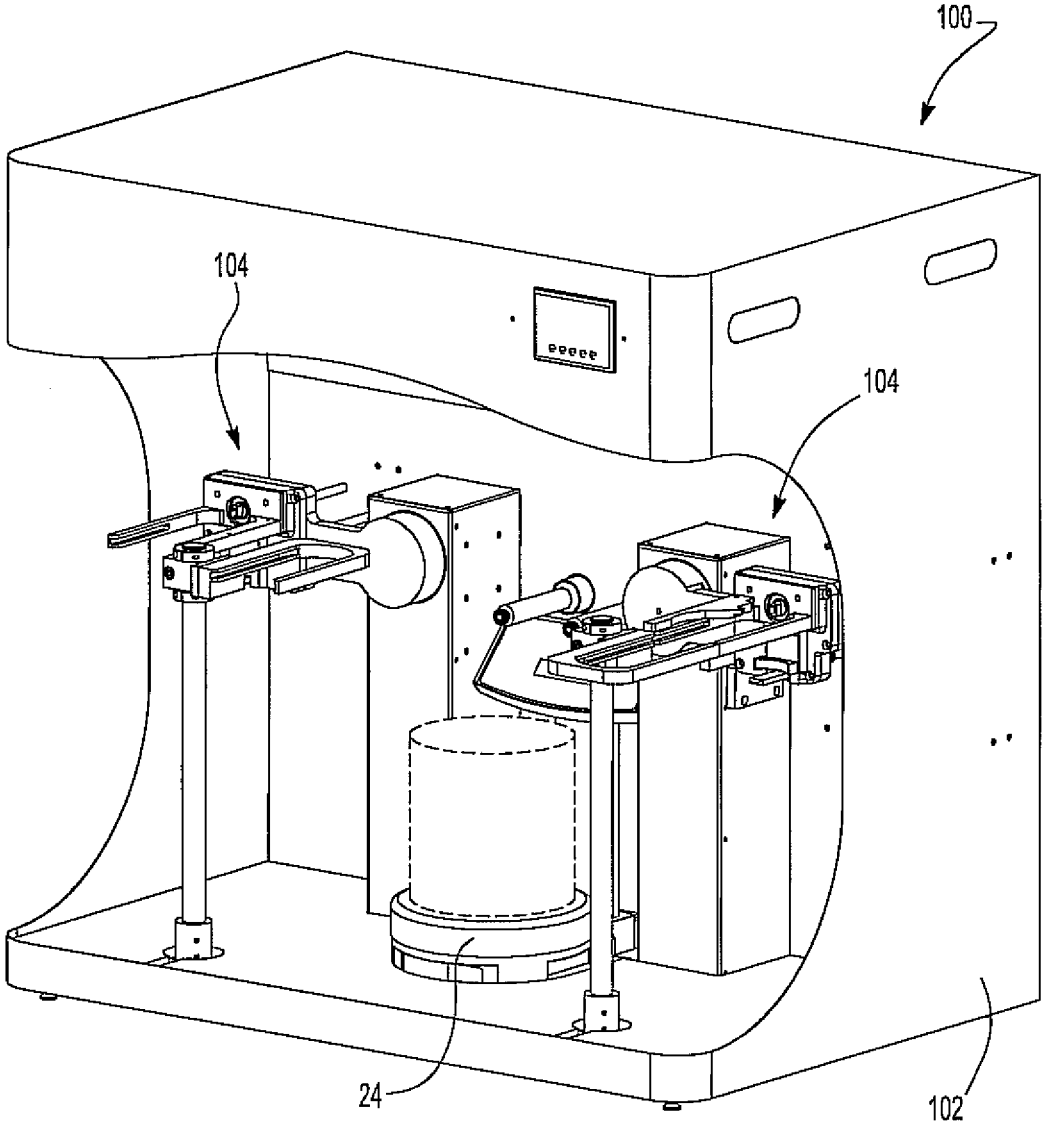
FIG. 9 is an elevational view illustrating a second preferred embodiment of the invention.
Figure 10:
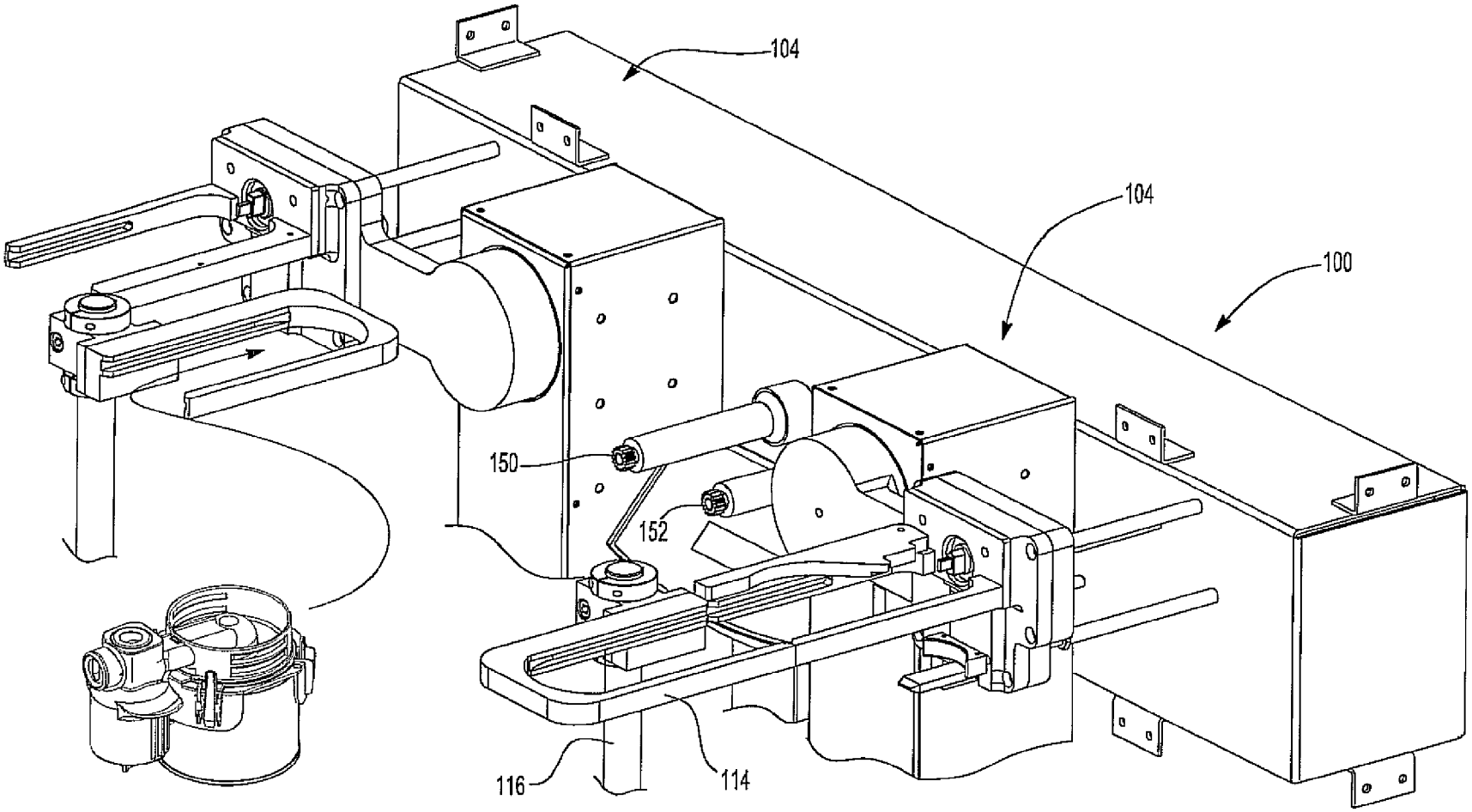
FIG. 10 is a view similar to FIG. 9, but enlarged and with parts removed.

With reference now to FIGS. 9 and 10, a second preferred embodiment of a paint formulation and dispensing apparatus 100 is shown. The paint formulation and dispensing apparatus 100 includes a housing 102 constructed of any rigid material, such as steel. The housing 102 supports the weight scale 24 near the bottom of the housing 102. As before, the weight scale 24 is adapted to support the paint can 28 (illustrated in phantom line) into which the paint is mixed.

The housing 102 includes at least one and preferably two receiving stations 104, each of which is laterally spaced from the weight scale 24 and so that the stations 104 are positioned on opposite sides of the weight station 24. The operation of each station 104 is a mirror image of the other. Consequently, the operation and construction of only a single receiving station 104 will be described in detail, it being understood that a like mirror description shall also apply to the other receiving station 104.

Figure 11:
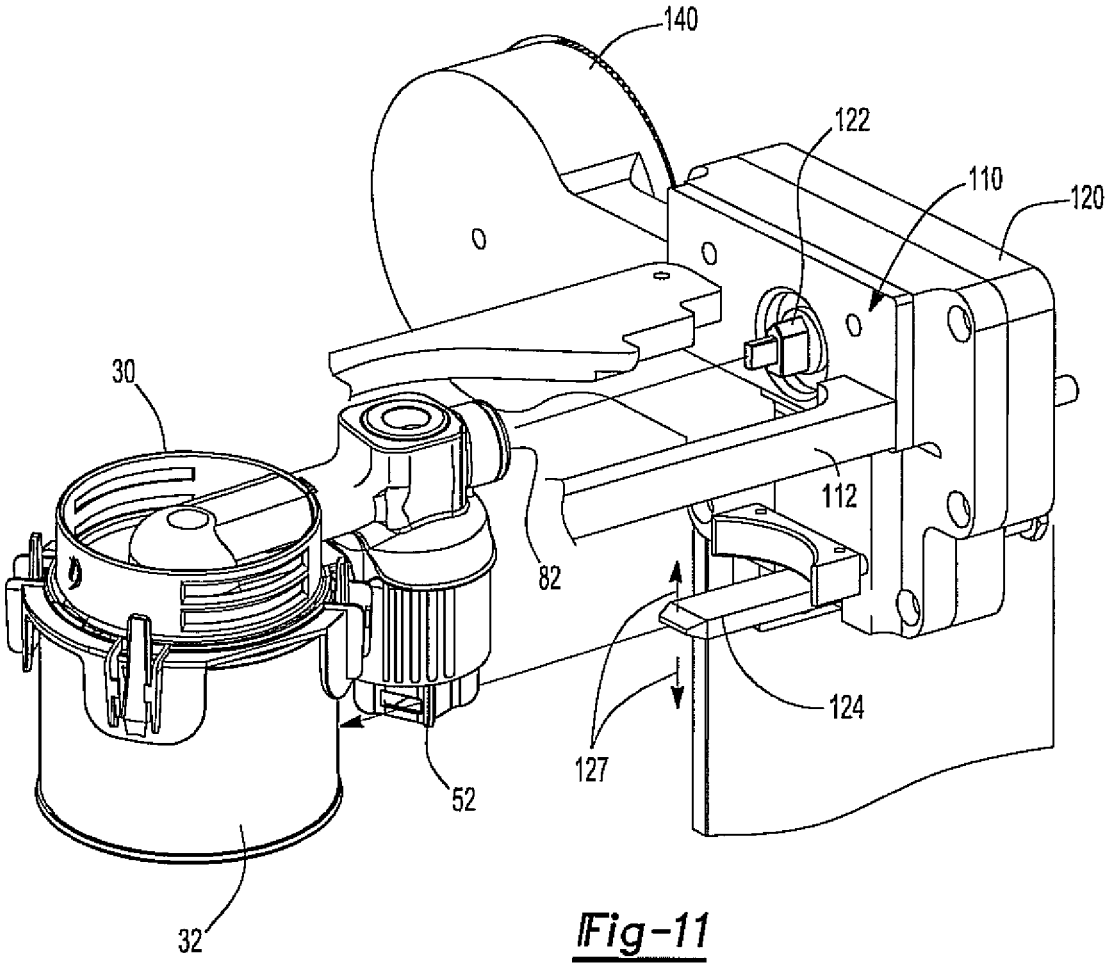
FIG. 11 is an elevational view illustrating loading a paint can into the mixing apparatus.
Figure 12:
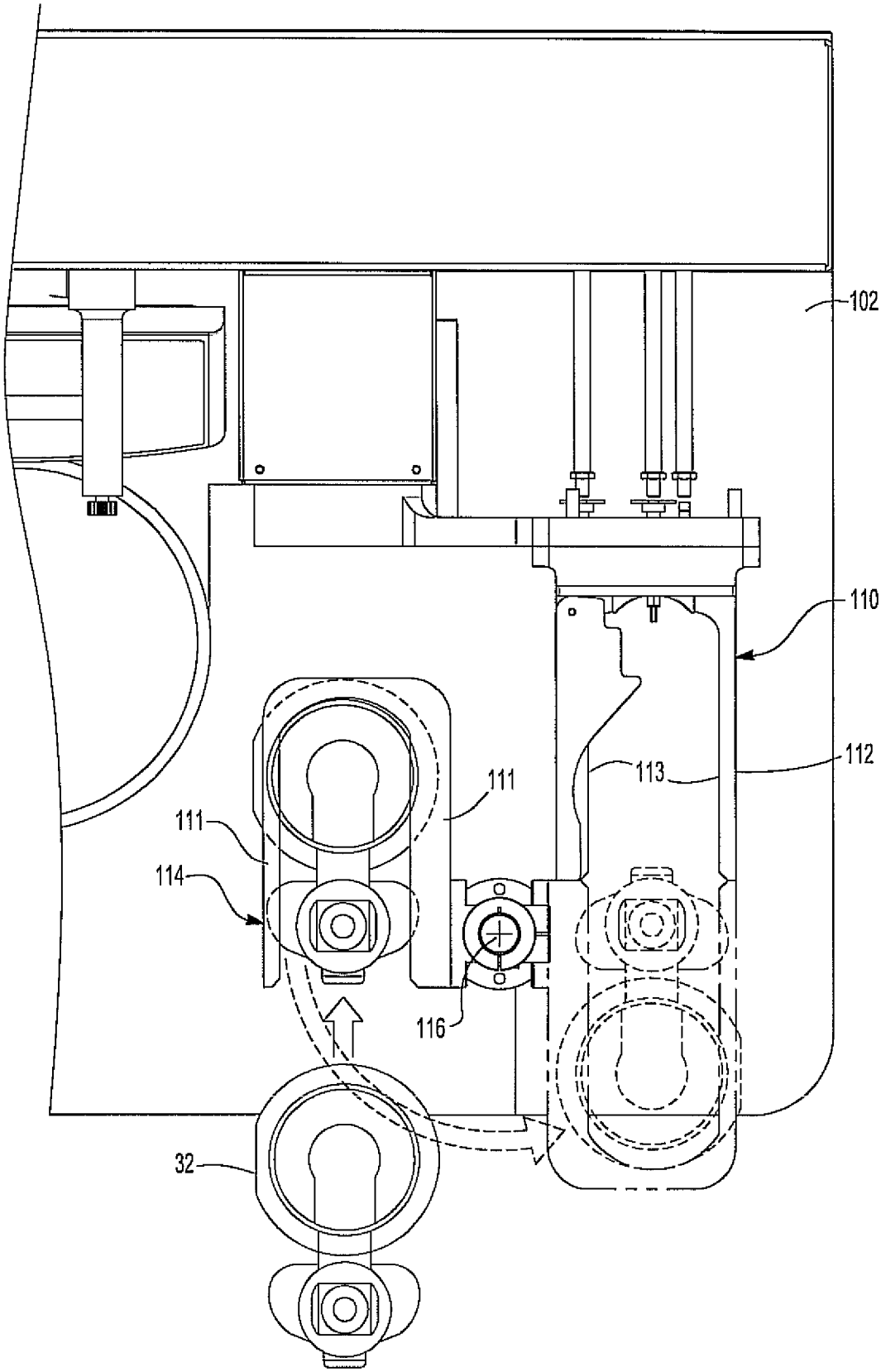
FIG. 12 is a fragmentary top view illustrating the operation of the clamp assembly.

With reference now particularly to FIGS. 11 and 12, a clamp assembly 110 includes a fixed part 112 and a movable part 114 (FIG. 12). The movable part 114 is movable between an open or staging position, illustrated in solid line in FIG. 12, and a closed position, illustrated in phantom line in FIG. 12. A shaft 116 is rotatably mounted to the housing and attached to the movable part 114 to rotate the movable part 114 between its open and closed position under control of the processor 26.

With the clamp assembly 110 in its open position, the movable part 114 of the clamp assembly 110 slidably receives the dispensing lid 30 when attached to the can 32 when in the non-inverted position, i.e. the lid 30 on top of the can 32. Although any mechanism may be used to slidably receive the paint can lid 30, preferably, the clamp assembly 12 includes spaced apart rails 111 which slide in slots formed in the lid 30.

Figure 13:
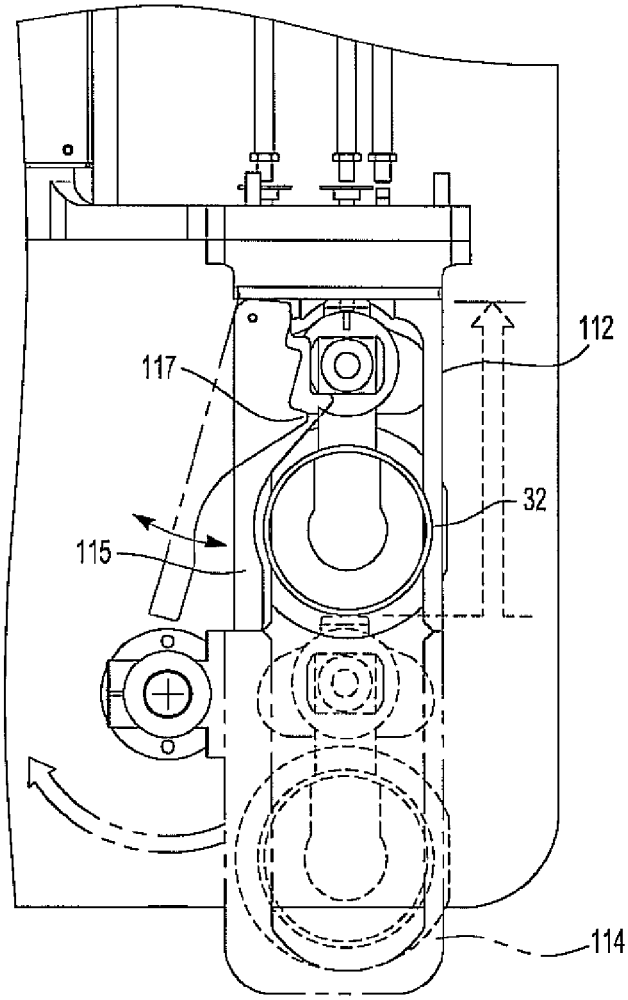
FIG. 13 is a view similar to FIG. 12, but showing the can and lid in a loaded position.

With reference to FIGS. 12 and 13, once the lid with the attached paint can is inserted into the movable part 114 of the clamp assembly 110, the movable part 114 of the clamp assembly 110 is manually rotated to its closed position. In doing so, the rails 111 on the movable part 114 are aligned with spaced apart rails 113 on the fixed part 112. The lid 30 and can 32 are then manually slid into the fixed part from the position shown in phantom line in FIG. 13 to the position shown in solid line in FIG. 13. Upon insertion, the lid 32 deflects a spring-loaded escapement 115 to the position shown in phantom line in FIG. 13. Upon full insertion, the escapement 115 returns to its undeflected position so that a protrusion 117 on the escapement 115 engages the lid 32 and locks the lid in its fully inserted position.

With reference now particularly to FIG. 11, a drive assembly 120 is attached to the fixed part 114 of the clamp assembly 112. The drive assembly 120 includes a first rotatable actuator 122 and a second vertically movable actuator 124. Upon insertion of the paint can lid 30 into the clamp assembly 112, the first actuator 122 drivingly engages the controller 82 of the paint can lid so that the actuator 122 and controller 82 rotatably move in unison with each other. Similarly, the second actuator 124 drivingly engages the plunger 52 so that the plunger 52 moves in unison with the actuator 124. Furthermore, when the clamp assembly 110 is moved to its closed position, the actuators 122 and 124 are locked to the valve and plunger 52, respectively.

Figure 14:
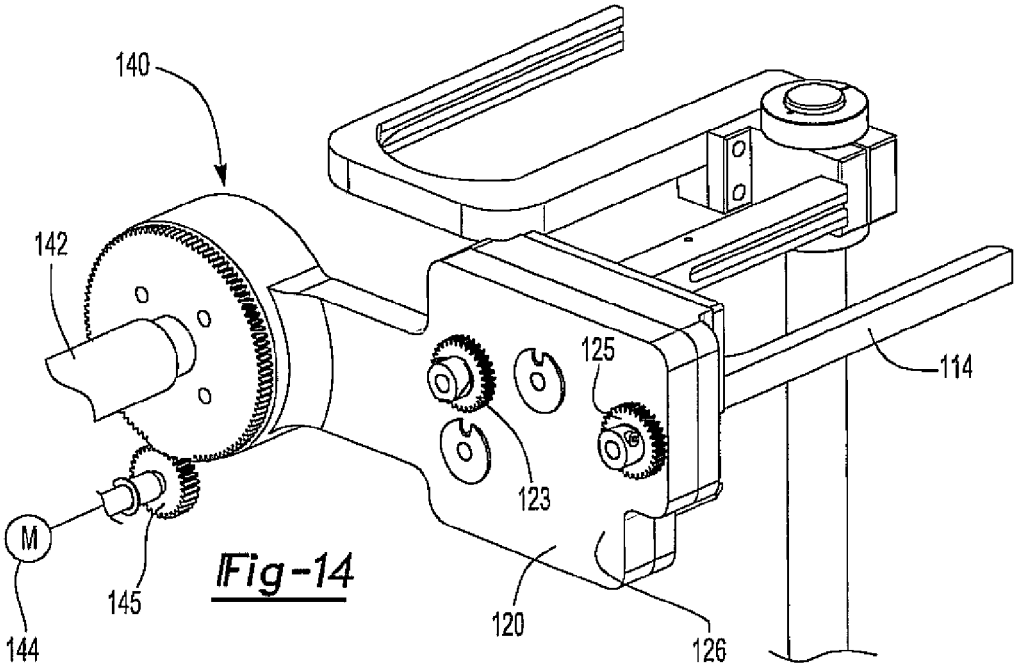
FIG. 14 is a fragmentary rear view of the transmission.

As best shown in FIG. 14, the drive assembly 120 includes a pair of spaced apart rotary drive inputs 123 and 125 on its rear surface 126, i.e. the surface facing the housing 102. The input drives 123 and 125 are mechanically coupled through a conventional transmission contained within the drive mechanism 120 to both rotatably drive the first actuator 122 as well as to vertically move the second actuator 124 between an upper and lower position as shown by arrows 127 in FIG. 11. Any conventional mechanism, such as a rack and pinion, may be used to vertically displace the second actuator 124. Likewise, the first actuator 122 may be coupled directly to the input drive 128 or may be mechanically coupled through mechanical gears or other mechanical drive means.

Figure 15:
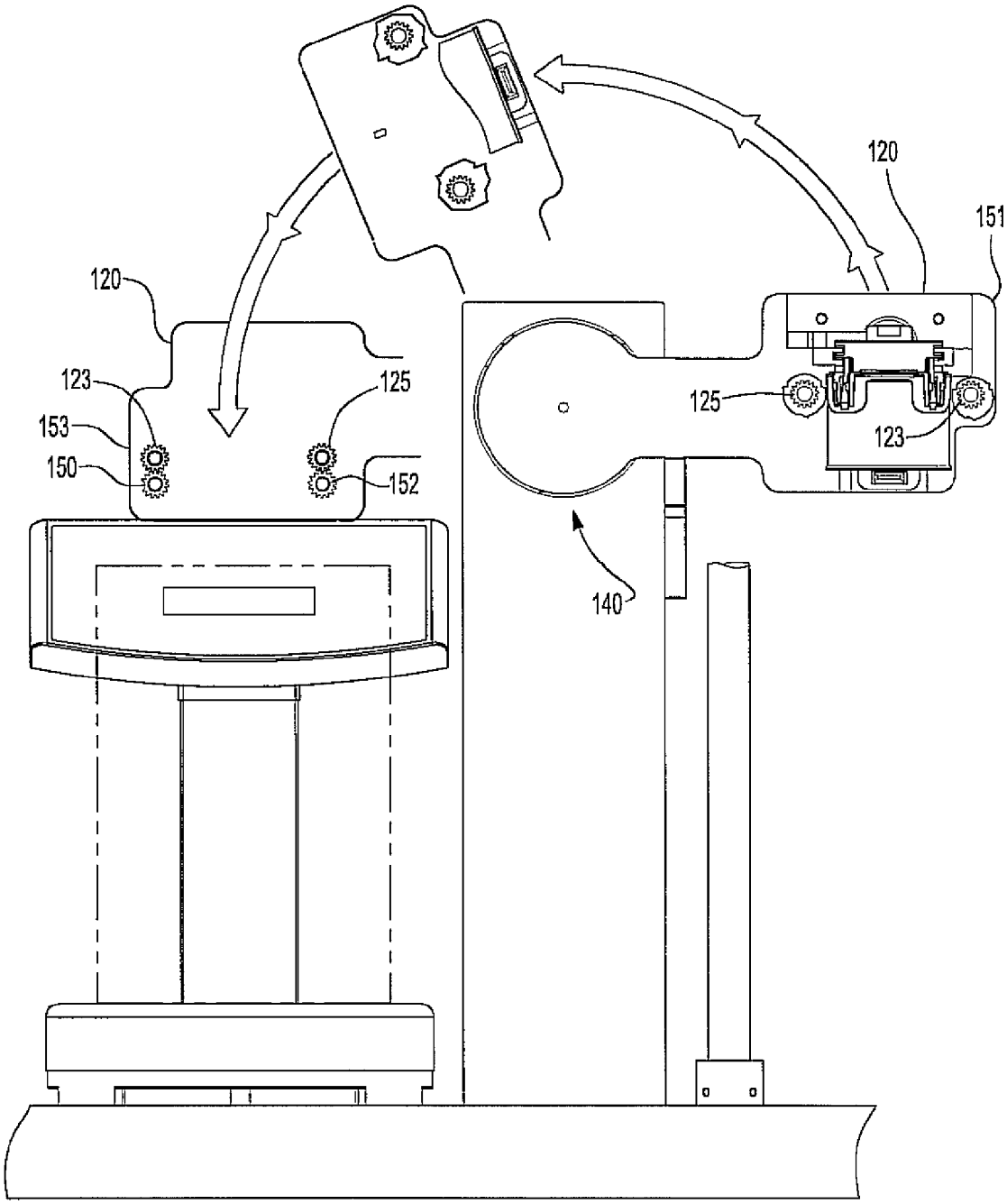
FIG. 15 is a side view of the transmission illustrating the operation of the plunger actuator.

With reference now to FIGS. 14 and 15, an inverter 140 is attached to the drive 120 and rotatably mounted to the housing 102 by a shaft 142. A controllable motor 144 is mechanically drivingly connected to the inverter via a drive gear 145 to rotatably drive the inverter although, alternatively, the drive motor 144 may directly rotatably drive the inverter 140 through the shaft 142. The drive motor 144 is preferably a stepper motor or DC controlled motor and, under control of the processor 26, rotatably moves the drive 120 with its attached clamp assembly 110 between a loading position, illustrated in solid line at 151 in FIG. 15, and a mixing position, illustrated in solid line at 153 in FIG. 15. In its mixing position (solid line at 153 in FIG. 15) the lid together with its attached paint can is positioned above the scale 24 in an inverted position, i.e. with the paint can above the lid.

With reference now particularly to FIGS. 10 and 15, with the lid and paint can in its mixing position, the input drive gears 123 and 125 on the drive 120 respectively mesh with drive gears 150 and 152 rotatably mounted to the housing 102. Each drive gear 150 and 152 is rotatably driven under control of the processor 28 by their respective drive shafts. Thus, rotation of the drive gear 150 rotatably drives the input drive gear 128 to control the operation of the valve. Conversely, rotation of the other drive gear 152 rotatably drives the input drive 130 to control the vertical position of the second actuator 124 and thus the position of the plunger 32 to thereby control the amount of paint dispensed into the receiving can 28 on the scale 24.

Although the operation of the paint formulation and dispensing apparatus 100 should be clear, in summary the lid with its attached paint can is first loaded into the movable part of the clamp assembly 110 when in its open position. The movable part 114 of the clamp assembly 110 is then rotated to its closed position and the paint can 32 and lid 30 are manually slid into the fixed part 112 of the clamp assembly 110 until locked in place by the escapement 115. Simultaneously, the actuators 122 and 124 on the drive 120 drivingly connect with both the valve 82 as well as the plunger 52 on the lid 30.

The inverter 140 then rotates the fixed part 114 clamp assembly 112 with its attached lid and paint can to an inverted position over the weight scale 24 and thus over the can 28 positioned to receive the paint. Once in its mixing position, the actuator drives 150 and 152 automatically engage the input drive pinions 128 and 130 on the drive 120 to control the position of both the valve on the paint can lid as well as the position of the plunger, all under program control of the processor 26.

When the desired amount of paint has been dispensed, the valve is closed and the inverter 140 returns the paint can to its non-inverted loading position where that process is repeated.

The provision of the second receiving station allows a second can of paint to be mixed while the previous can of paint is removed from the clamp assembly 110 on the other receiving station and replaced with a different paint can and lid. This effectively increases the amount of paint that can be mixed with the mixing apparatus 100.

From the foregoing, it can be seen that the present invention provides a simple yet highly effective means for mixing paints to achieve desired end paint colors. Having described our invention, however, many modifications thereto will become apparent to those skilled in the art to which it pertains without deviation from the spirit of the invention as defined by the scope of the appended claims.

I claim:

1. A paint formulation and dispensing apparatus for mixing paint from a paint can having an open top and to a receiving can, said apparatus comprising:

a dispensing lid which is attached to the paint can so that the lid overlies the open top of the paint can, said lid having a spout, a reservoir and a fluid passageway fluidly connected to the open top of the paint can, a valve disposed in said passageway and movable between a first position in which said valve fluidly connects said passageway to said reservoir, and a second position in which said valve fluidly connects said reservoir with said spout, a plunger slidably disposed in and sealed to said reservoir so that the position of said plunger in said reservoir determines the volume of said reservoir, a weight scale positioned below said spout, the receiving can positioned on said weight scale, said weight scale generating an electronic signal representative of the weight on said weight scale, a movable actuator which detachably engages and controls the position of said plunger, a processor which receives said electronic signal as an input signal and generates output signals to control the position of said actuator and said valve.

2. The apparatus as defined in claim 1 wherein said valve comprises an axially extending channel which fluidly connects the open top of the paint can to said reservoir when said valve is in said first position.

3. The apparatus as defined in claim 2 and comprising a bore extending axially through said valve, said bore fluidly connecting said reservoir to said spout when said valve is in said second position.

4. The apparatus as defined in claim 1 wherein said spout and said reservoir are vertically aligned with each other.

5. The apparatus as defined in claim 1 wherein said valve is rotatably movable between said first and said second positions.

6. The apparatus as defined in claim 1 wherein said processor is programmed to at least partially fill said reservoir by moving said plunger outwardly from said lid after said actuator engages said plunger and said valve is in said first position.

7. The apparatus as defined in claim 1 wherein said lid is of a plastic construction.

8. The apparatus as defined in claim 1 and comprising an electronic database containing color data said processor having access to said database.

9. The apparatus as defined in claim 1 wherein said plunger comprises a handle accessible exteriorly of said lid, said actuator selectively engaging said handle.

10. The apparatus as defined in claim 1 and comprising a housing, said weight scale being mounted to said housing, and a support for mounting said lid in a predetermined position so that said spout is vertically aligned with said scale.

11. The apparatus as defined in claim 10 wherein with said lid positioned on said support, the paint can extends upwardly from said lid so that the open top of the paint can faces downwardly.

12. The apparatus as defined in claim 1 and comprising:

a housing which supports said weight scale, at least one container receiving station in said housing laterally spaced from said weight scale, a clamp assembly at said receiving station, said clamp assembly having an escapement which locks said lid to said clamp assembly upon full insertion of said lid into said clamp assembly, an inverter attached to said clamp assembly which, under control of the processor, moves said clamp assembly and attached lid from a loading position in which said lid and can are laterally spaced from said weight scale with said lid above said can, and a mixing position in which said lid and can are inverted and positioned above said weight scale.

13. The apparatus as defined in claim 12 wherein said inverter comprises a shaft rotatably mounted to said housing and attached to said inverter, and a motor under control of said processor for selectively rotating said inverter between said loading and said mixing positions.

14. The apparatus as defined in claim 12 wherein said clamp assembly comprises a pair of spaced apart rails which engage slots in said lid.

15. The apparatus as defined in claim 12 and comprising a drive attached to said clamp assembly, said drive having a first actuator which rotatably drivingly connects to said valve and a second actuator which slidingly engages said plunger when said clamp assembly is in said closed position, said first and second actuator respectively moved by first and second input drives on said drive.

16. The apparatus as defined in claim 15 and comprising first and second actuator drive shafts rotatably mounted to said housing and rotatably driven under control of said processor, said actuator drive shafts automatically drivingly engaging said drive first and second input drives when said inverter moves from said loading position to said mixing position.

17. The apparatus as defined in claim 12 and comprising a second receiving station mounted to said housing on a side of said weight scale opposite from said first receiving station.

* * * * *